US008360552B2

(12) United States Patent
Justice et al.

(10) Patent No.: US 8,360,552 B2
(45) Date of Patent: Jan. 29, 2013

(54) CARRIAGE FOR CARRYING A FLUID EJECTOR CARTRIDGE

(75) Inventors: Greg K. Justice, Vancouver, WA (US); Jeffrey T. Hendricks, Camas, WA (US); Michael L. Hilton, Vancouver, WA (US); Patrick Therien, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 227 days.

(21) Appl. No.: 12/896,894

(22) Filed: Oct. 3, 2010

(65) Prior Publication Data

US 2011/0018948 A1 Jan. 27, 2011

Related U.S. Application Data

(63) Continuation of application No. PCT/US2008/059270, filed on Apr. 3, 2008.

(51) Int. Cl.
*B41J 2/15* (2006.01)
*B41J 23/00* (2006.01)

(52) U.S. Cl. ..... 347/37; 347/22

(58) Field of Classification Search ..... 347/37
See application file for complete search history.

(56) References Cited

U.S. PATENT DOCUMENTS

| | | | | |
|---|---|---|---|---|
| 6,190,007 | B1 | 2/2001 | Taylor et al. | |
| 6,220,699 | B1 | 4/2001 | Taylor et al. | |
| 6,367,918 | B1 | 4/2002 | Heiles et al. | |
| 6,419,343 | B1 | 7/2002 | Taylor et al. | |
| 6,481,838 | B1 * | 11/2002 | Brugue et al. | 347/85 |
| 2006/0268078 | A1 * | 11/2006 | Kumagai | 347/85 |
| 2006/0274131 | A1 * | 12/2006 | Noguchi et al. | 347/85 |
| 2007/0222828 | A1 | 9/2007 | Stathem et al. | |

FOREIGN PATENT DOCUMENTS

JP 60196350 A * 10/1985

* cited by examiner

*Primary Examiner* — Shelby Fidler

(57) ABSTRACT

In one embodiment, a carriage for carrying a fluid ejector cartridge includes: a body having a bay therein for holding a fluid ejector cartridge; a pump mounted to the body; a retaining cover connected to the body, the cover movable between an open position in which the cartridge may be installed in or removed from the bay and a closed position in which the cover contacts the cartridge in the bay to help retain the cartridge in place in the bay; and a port disposed within the cover such that the cover port is connected to a port on the cartridge when the cartridge is installed in the bay and the cover is in the closed position, the cover port operatively connected to the pump so that a fluid may be pumped into the cartridge through the cover and cartridge ports.

19 Claims, 7 Drawing Sheets

CARRIAGE FOR CARRYING A FLUID EJECTOR CARTRIDGE

CROSS-REFERENCE TO RELATED PATENT APPLICATIONS

The present application is a continuation of co-pending PCT/US2008/059270 filed on Apr. 3, 2008 by Greg K. Justice, Jeffrey T. Hendricks, Michael L. Hilton and Patrick Therien and entitled CARRIAGE FOR CARRYING A FLUID EJECTOR CARTRIDGE, the full disclosure of which is hereby incorporated by reference.

BACKGROUND

Inkjet printers fire drops of ink from the nozzles in a printhead of an ink pen on to paper or other print media. Ink pens are sometimes also referred to as print cartridges or ink cartridges. In many types of inkjet printers, several ink pens are mounted on a movable carriage that traverses back and forth across the width of the paper feeding through the printer. Each ink pen dispenses one or sometimes two different colored inks. The pressure in each ink pen is managed to help control the flow of ink to the printhead. For example, if the ink pen lacks sufficient to back pressure, ink may leak from the printhead nozzles. Alternatively, if the back pressure in the ink pen is excessive, the printhead may not fire properly. However, even with effective back pressure management, the printhead may lose its prime due to the accumulation of air bubbles or other gases in the printhead, limiting the ability of the printhead to properly receive or dispense ink. Also, nozzles sometimes become clogged. Thus, it is sometimes necessary to push ink through the printhead, or pull ink from the printhead, to clear clogged nozzles and/or to re-prime the printhead.

To push ink through the printhead to clear clogged nozzles and/or to prime the printhead, air is pumped into a pressure regulator chamber in the ink pen to push ink out through the nozzles along with any gas bubbles that may have been trapped in the printhead. Pushing ink out of the nozzles in this manner is referred to as "pressure priming", "push priming" or "pressure purging." Conventional pressure priming systems either have not been adapted for use with a movable carriage or they have not been contained on-board the carriage. Where the pump is remote from the carriage, the air connection between the pump and the ink pens on-board the carriage must be made and then broken each time a purge/prime is conducted.

DRAWINGS

DESCRIPTION

Embodiments of the disclosure were developed in an effort to contain a pressure priming system fully on-board a movable carriage in an inkjet printer or other device that uses a fluid ejector cartridge. Embodiments are described with reference to an inkjet printer that utilizes a movable carriage to carry detachable/removable ink pens back and forth across the print media. Embodiments of the disclosure, however, are not limited to such implementations. Embodiments of the disclosure, for example, might also be implemented in other types of ink or fluid dispensing devices that utilize a movable carriage that carries fluid dispensing units. The example embodiments shown in the Figures and described below, therefore, illustrate but do not limit the scope of the disclosure.

As used in this document, a "plunger" means a part that can slide or otherwise move back and forth in a recess or sleeve; a "port" means an opening or passage through which a fluid may pass; and a "vent" means an opening to an ambient pressure, usually an opening to the atmosphere.

Figure 1:
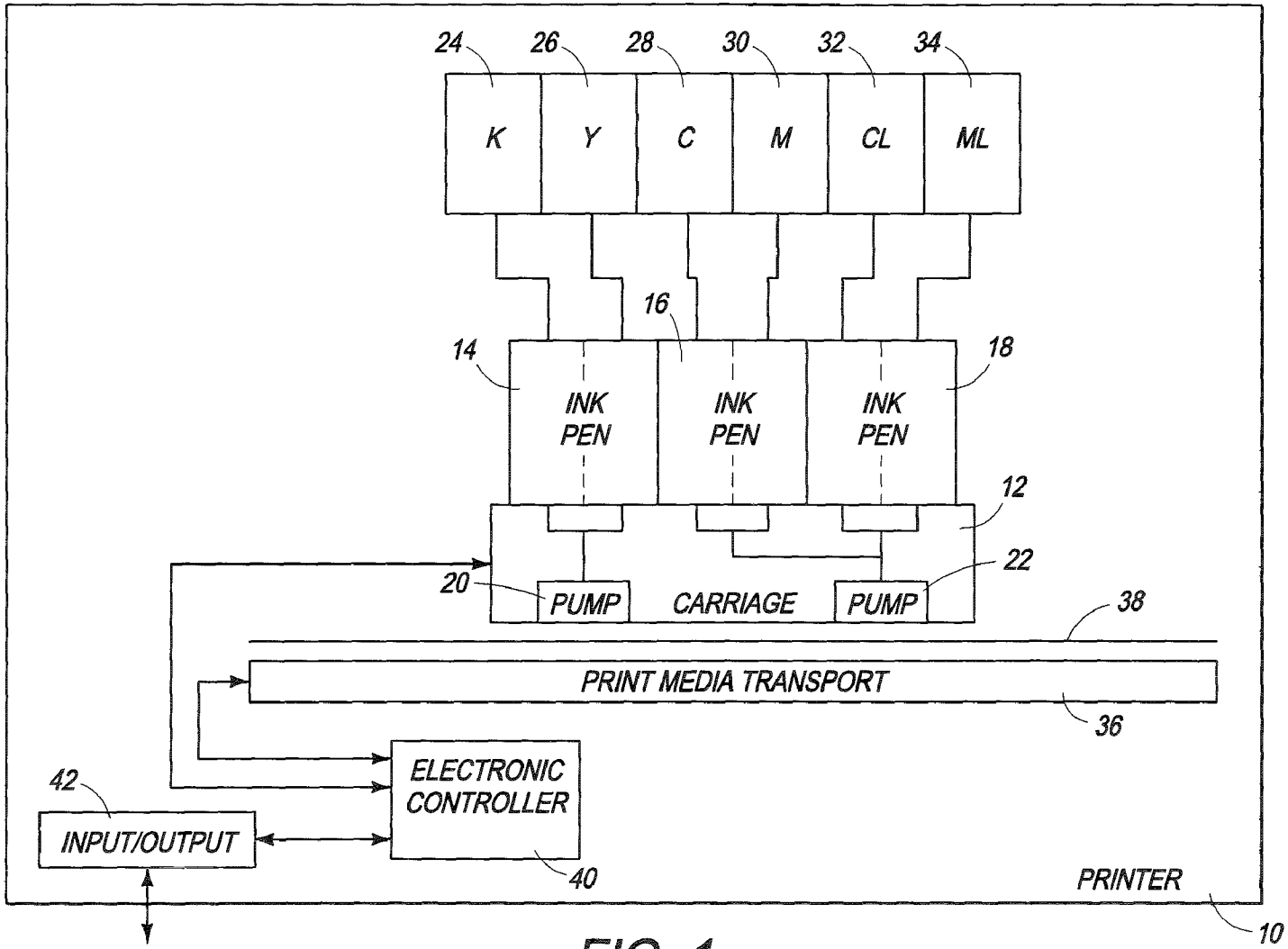
FIG. 1 is a block diagram of an inkjet printer according to an embodiment of the disclosure.

FIG. 1 is a block diagram illustrating an inkjet printer 10 constructed according to one embodiment of the disclosure. Inkjet printer 10 represents more generally a fluid-jet precision dispensing device or fluid ejector for precisely dispensing a fluid, such as ink. Referring to FIG. 1, printer 10 includes a carriage 12 carrying removable ink pens 14, 16 and 18 and pressure priming pumps 20 and 22. Ink is supplied to ink pens 14-18 from a series of ink supplies 24, 26, 28, 30, 32 and 34 located remote from carriage 12. Such ink supplies are often referred to as "off-axis" ink supplies because they are not carried by carriage 12 (as opposed "on axis" ink supplies that are integral to the ink pens carried by the movable carriage). In the embodiment shown, as described in detail below, each ink pen 14-18 dispenses two inks, effectively combining two pens into a single unit. For example, ink pen 14 dispenses black (K) and yellow (Y) inks, ink pen 16 dispenses cyan (C) and magenta (M) inks, and ink pen 18 dispenses light cyan (CL) and light magenta (ML) inks.

A print media transport mechanism 36 advances print media 38 lengthwise past carriage 12 and pens 14-18. For a movable, scanning carriage 12, media transport 36 typically will advance media 38 incrementally past carriage 12, stopping as each swath is printed and then advancing media 38 for printing the next swath. An electronic controller 40 is operatively connected to carriage 12, ink pens 14-18, pumps 20, 22 and media transport 36. Controller 40 communicates with external devices through an input/output device 42, including receiving print data for inkjet imaging. The presence of an input/output device 42, however, does not preclude the operation of printer 10 as a stand alone unit. Controller 40 controls the movement of carriage 12 and media transport 36. Controller 40 is electrically connected to the printheads in each ink pen 14-18 to selectively energize the firing resistors, for example, to eject ink drops on to media 38. By coordinating the relative position of carriage 12 with media 38 and the ejection of ink drops, controller 40 produces the desired image on media 38.

Embodiments of the present disclosure are not limited to inkjet printers. In general, embodiments of the present disclosure pertain to any type of fluid-jet precision dispensing device or fluid ejector for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printers. Other examples of substantially liquid fluids include drugs, cellular products, organisms, chemicals, fuel, and so on, which are not substantially or primarily composed of gases such as air and other types of gases. Therefore, while the following description relates to inkjet printer components for ejecting ink onto media, embodiments of the present disclosure more generally pertain to any type of fluid-jet precision dispensing device or fluid ejector for dispensing a substantially liquid fluid.

Figure 2:
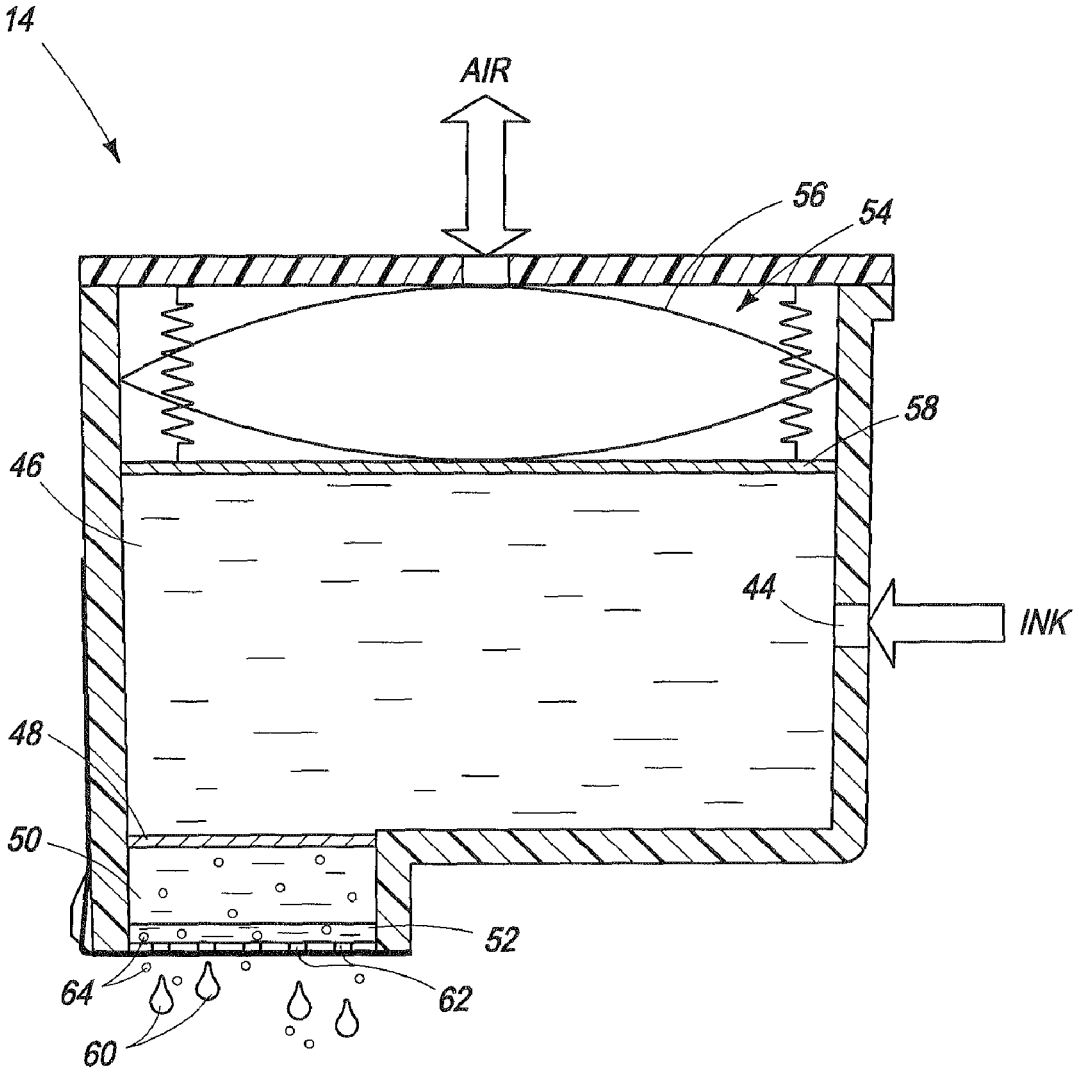
FIG. 2 is a diagrammatic illustration of an ink pen undergoing pressure priming.

FIG. 2 is a simplified diagrammatic illustration of an ink pen 14, 16 or 18 undergoing pressure priming. For convenience, the ink pen in FIG. 2 is designated by part number 14. Ink is pumped or otherwise introduced into pen 14 from a separate ink supply through an inlet 44 to a pressure regulating chamber 46. Ink flows from regulator chamber 46 through a filter 48 and standpipe region 50 to a printhead 52, where it may be ejected on to print media as described above. An inkjet printhead is typically a small electromechanical assembly that contains an array of miniature thermal, piezoelectric or other devices that are energized or activated to eject small droplets of ink out of an associated array of nozzles. A typical thermal inkjet printhead, for example, includes a nozzle plate arrayed with ink ejection nozzles and firing resistors formed on an integrated circuit chip.

In many inkjet printers, ink flows to the printhead at a slight negative pressure (vacuum) to control the free flow of ink through the ink ejection nozzles when the printhead is not activated. Without such negative pressure, ink may leak or "drool" from the nozzles. A pressure regulator 54 in chamber 46 is used to help maintain the pressure in chamber 46 and printhead 52 within a desired range of negative pressures. A so-called "spring bag" regulator 54 is illustrated in FIG. 2. Spring bag regulator 54 includes an expandable and collapsible bag 56 and a pressure plate 58. Bag 56 may be vented to the atmosphere as plate 58 exerts a predetermined pressure on bag 56, urging/biasing bag 56 toward a desired volume within the proper operating range of backpressures in chamber 46. Plate 58 is operatively linked to a valve (not shown) that controls the flow of ink into chamber 46.

At a steady state, the flow control valve is closed and pressure plate 58 is compressing bag 56 against the ambient pressure, usually atmospheric pressure, inside bag 56. Ejecting ink from printhead 52 lowers the pressure in chamber 46, allowing bag 56 to expand and move plate 58 outward. The pressure in chamber 46 continues to decrease as ink is ejected from printhead 52 until the moving plate 58 opens the flow control valve, allowing ink to flow into regulator chamber 46. Ink from the pressurized supply increases the pressure in chamber 46, moving plate 58 inward to collapse bag 56 until the flow control valve closes. This process of opening and closing the flow control valve and filling regulator chamber 46 with ink is repeated over and over in order to supply ink to the printhead at the desired pressure. For pressure priming/purging, air is momentarily pumped into bag 56 at a comparatively high pressure to rapidly expand bag 56 enough to push ink 60 out of printhead nozzles 62 along with any gas bubbles 64 that may have accumulated in printhead 52, as illustrated in FIG. 2.

Figure 3:
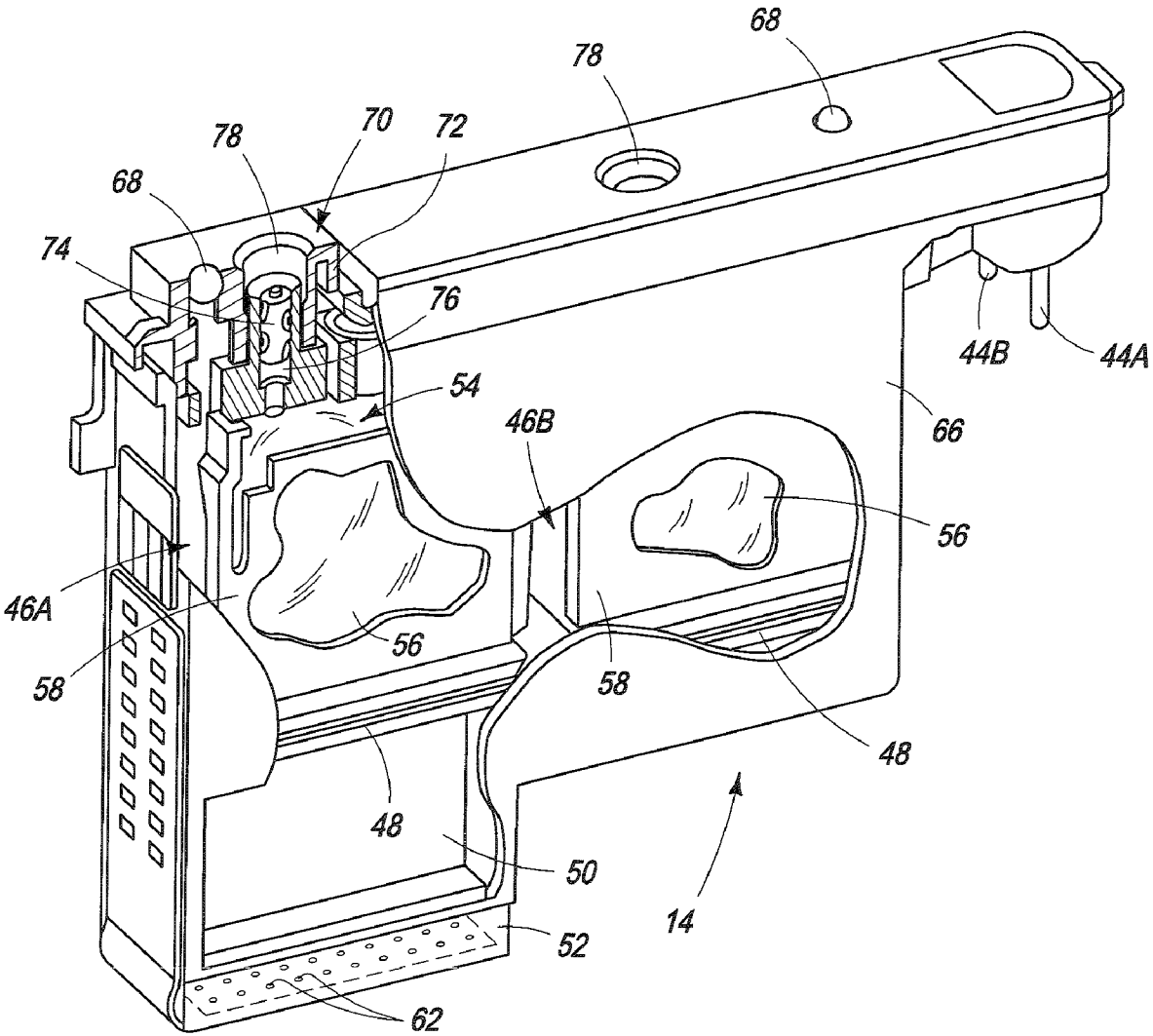
FIG. 3 is a perspective and partial cut-away view illustrating an ink pen.

FIG. 3 is a perspective and partial cut-away view illustrating one embodiment of an ink pen 14, 16 or 18 that may be used with embodiments of the new carriage mounted pumping system. For convenience, the ink pen in FIG. 3 is designated by part number 14. The same part numbers are used to designate like components in both FIGS. 2 and 3. Referring to FIG. 3, ink pen 14 is configured to receive and eject two inks. In the configuration shown in FIG. 1, for example, ink pen 14 receives and ejects black (K) and yellow (Y) inks. The operative components of pen 14 are housed in a housing 66. Pen housing 66 often will be constructed as an assembly of several different parts, which are not shown or designated separately in FIG. 3.

Ink is supplied to pen 14 through ink inlets 44A and 44B to regulator chambers 46A and 46B. Chamber 46A is positioned toward the front of pen 14 and chamber 46B is position toward the rear of pen 14. The components for the "A" and "B" parts of pen 14 are the same. Therefore, for convenience, the "A" and "B" part number designations are dropped and a single part number used singularly to designate the same components in both the A part and the B part of pen 14. A spring bag assembly type pressure regulator 54 in pressure regulating chamber 46 includes a bag 56 and a pressure plate 58. Ink flows from each chamber 46 to a printhead 52 through a respective filter 48, standpipe region 50 and associated flow channels (not shown). In a dual ink pen such as the pen 14 shown in FIG. 3, the printhead 52 for each ink/chamber may be positioned side by side, front to back, or a combination of both. Also, each printhead 52 may be constructed separately as a distinct chip, or formed together in a single chip.

Fill ports 68 and vents 70 are located along the top of pen housing 66. Fill ports 68, which are connected to chambers 46, are sealed with a ball cork after the pen is initially filled with ink. Each vent 70 is operatively connected to the interior of a spring bag 56 such that air can flow into and out of bag 56 through vent 70. In the embodiment shown, each vent 70 includes a vent fitment 72 mounted in housing 66 and a labyrinth plug 74. Each fitment 72 defines an air passage 76 to an opening 78 in housing 66. Labyrinth plug 74 restricts the flow of air through passage 76 to help regulate the pressure in bag 56. A labyrinth plug 74 is a plug with one or more grooves in its exterior surface. The grooves allow air to pass along the plug. Fewer, smaller and/or more circuitous grooves are more restrictive while more, larger and/or less circuitous grooves are less restrictive.

Figure 4:
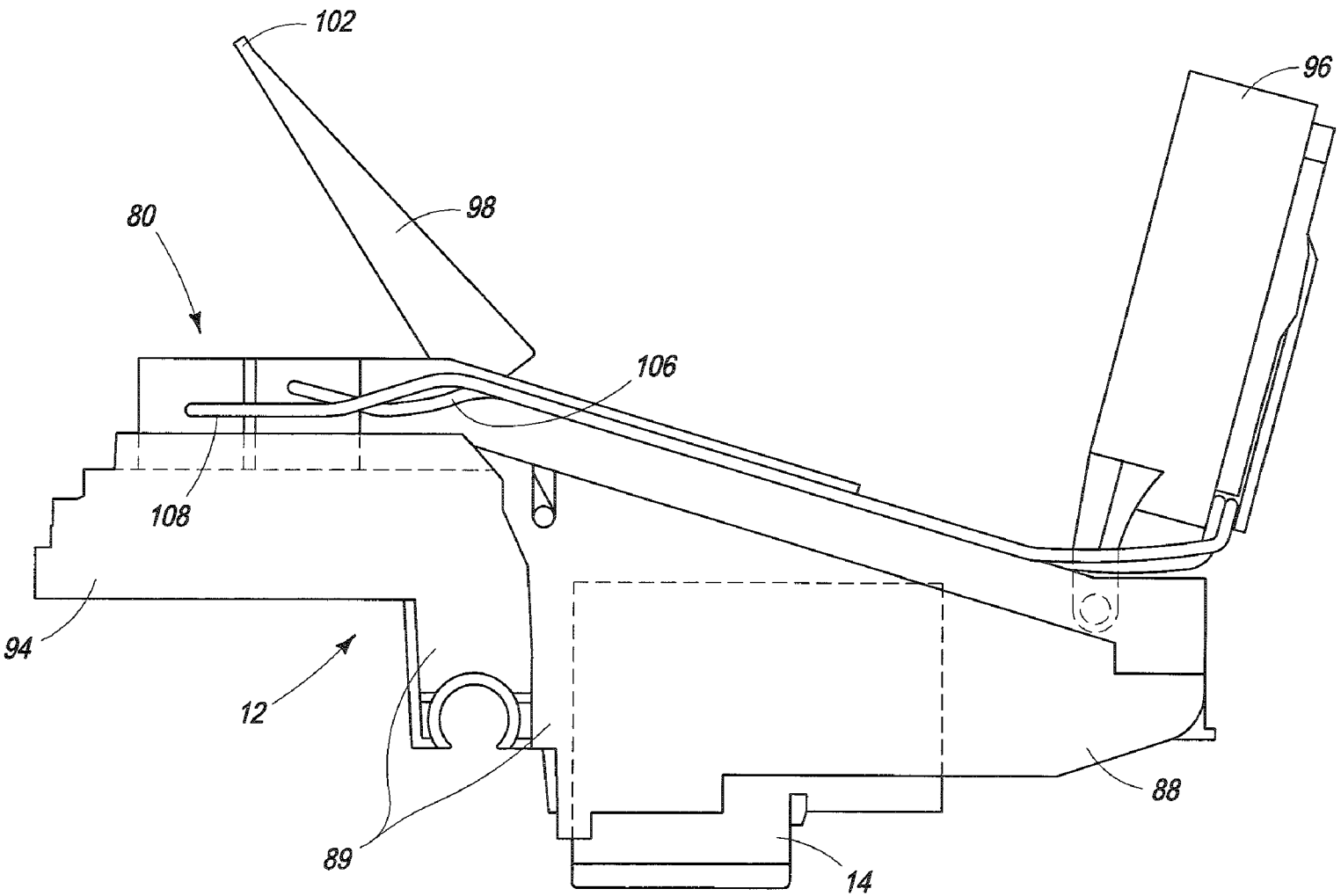
FIGS. 4 and 5 are side elevation and plan views, respectively, of an inkjet printer carriage carrying three ink pens, according to an embodiment of the disclosure.
Figure 5:
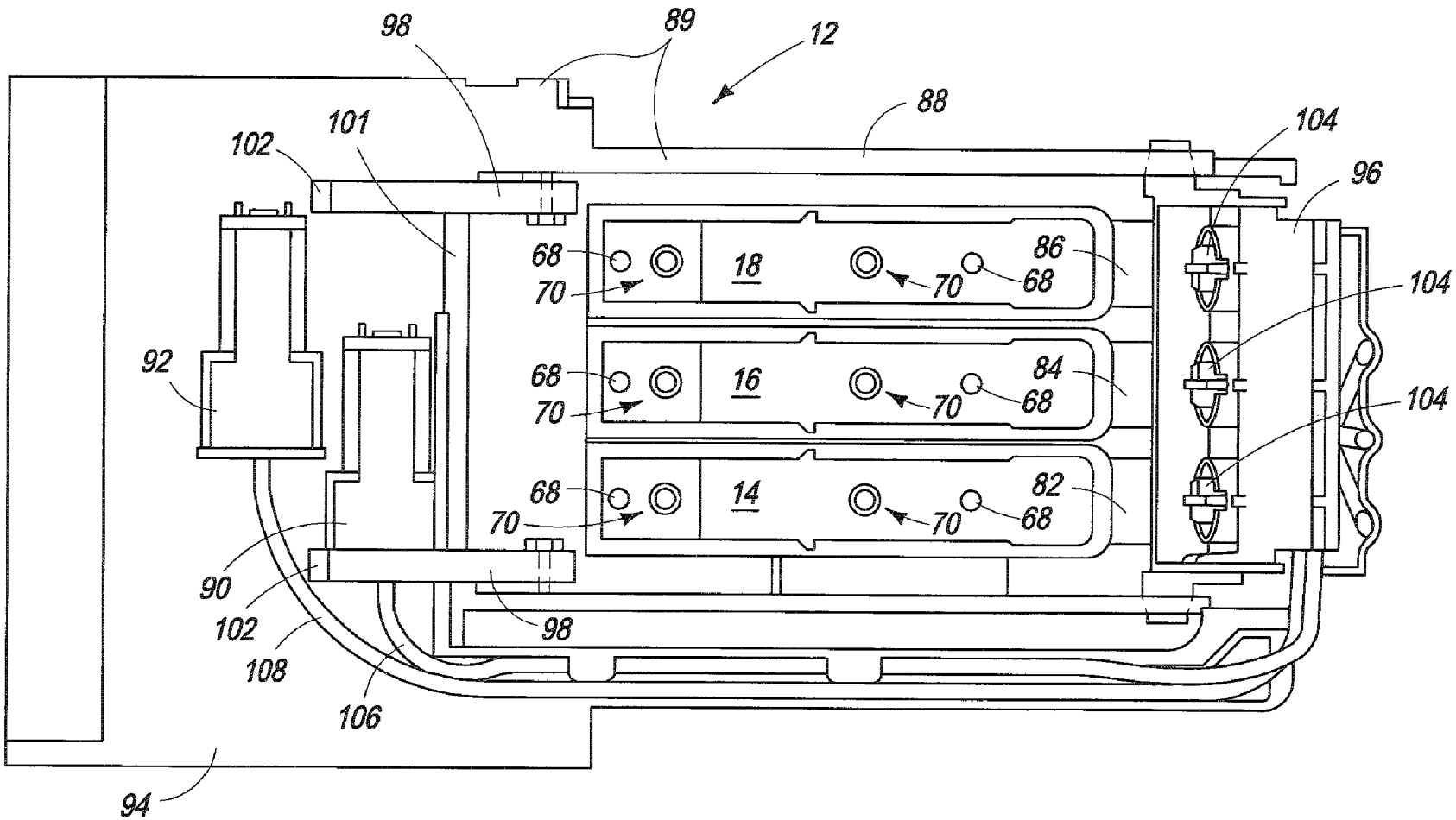
Figure 6:
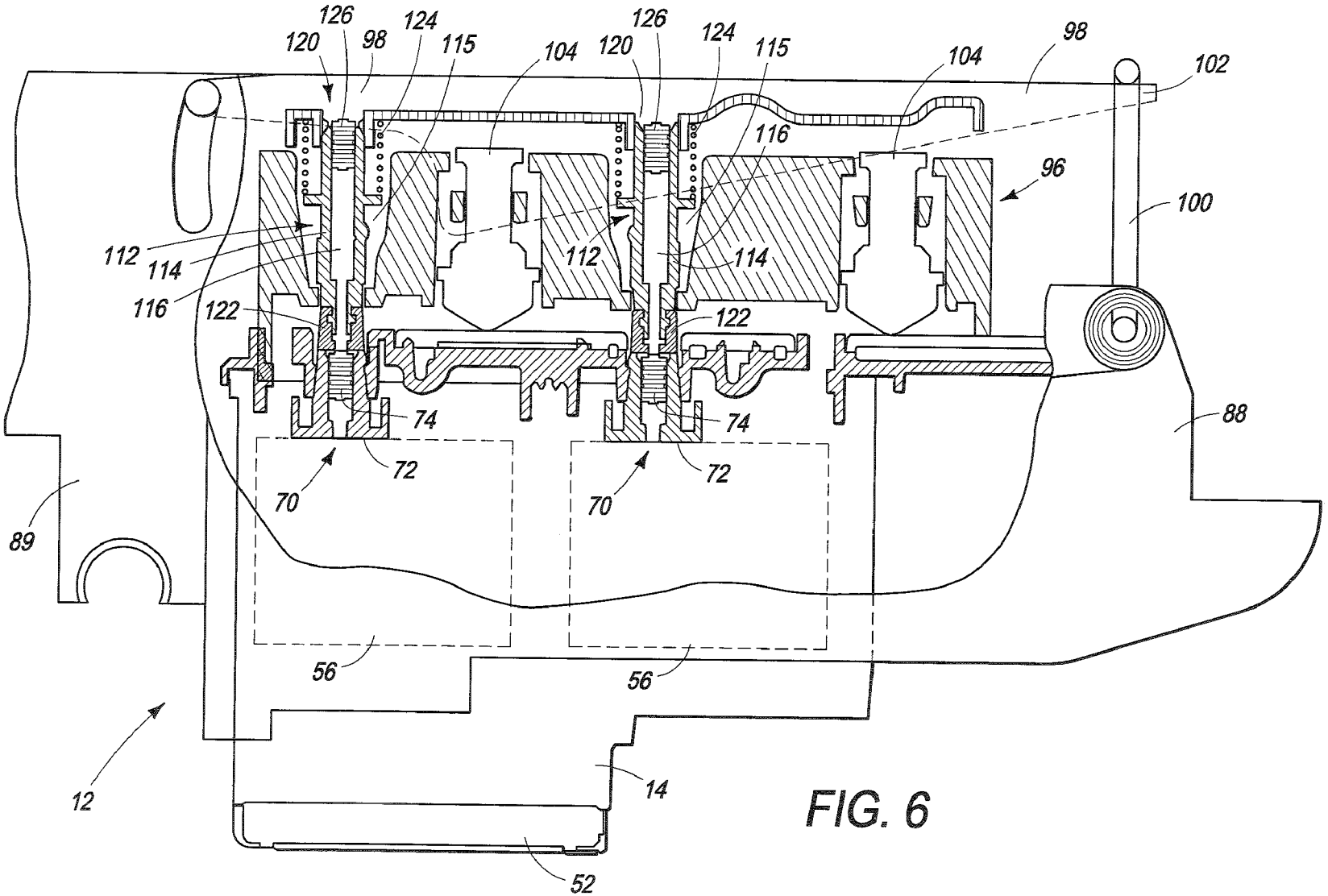
FIG. 6 is a partial section view of the carriage shown in FIGS. 4 and 5.

FIGS. 4 and 5 are side elevation and plan views, respectively, illustrating one embodiment of an inkjet printer carriage 12 that includes a pressure purging/priming pump system 80. FIG. 6 is a partial section, more detailed view of carriage 12. Referring to FIGS. 4-6, each ink pen 14, 16 and 18 is held in a respective bay 82, 84 and 86 at a forward part 88 of the body 89 of carriage 12. Pump system 80 includes a pair of miniature air pumps 90, 92 (e.g., pumps 20, 22 in FIG. 1) mounted at a rearward part 94 of carriage body 89. The Koge KPM12C01 (12 mm×21 mm×45 mm) and Smart Pump AP-2P01 (12 mm×21 mm×48 mm) are examples of a suitable air pump 90, 92. Ink pens 14-18 are secured in place in bays 82-86 with a cover 96 that rotates between an open position, shown in FIGS. 4 and 5, in which pens 14-18 may be installed into and removed from bays 82-86, and a closed position, shown in FIG. 6, in which pens 14-18 are secured in place in bays 82-86.

Cover 96 is retained in the closed position with a pair of pivoting latch levers 98 and bail 100 (FIG. 6). Latch levers 98 may be linked to one another with a link 101 (FIG. 5) extending between the levers 98 as shown in FIG. 5. As best seen in FIG. 6, latch levers 98 pivot down along and bear against a ledge (not shown) on each side of cover 96. Only one latch lever 98 is visible in the side view of FIG. 6. Latch lever 98 is outlined with a dashed line in FIG. 6 where it overlaps the side of cover 96. Latch levers 98 are held in place with a bail 100 that pivots up and over the ends 102 of levers 98 as shown in FIG. 6. With cover 96 in the closed position, spring loaded pen retention pins 104 in cover 96 compress pens 14-18 into bays 82-86 to help secure pens 14-18 in the proper position. Accordingly, a reactive force acts on latch levers 98 to maintain tension on bail 100. Tension on bail 100 may be released and cover 96 opened and closed by pressing down on the ends 102 of levers 98, further compressing spring loaded pins 104, so that bail 100 may be flipped down/off and up/on lever ends 102.

Figure 7:
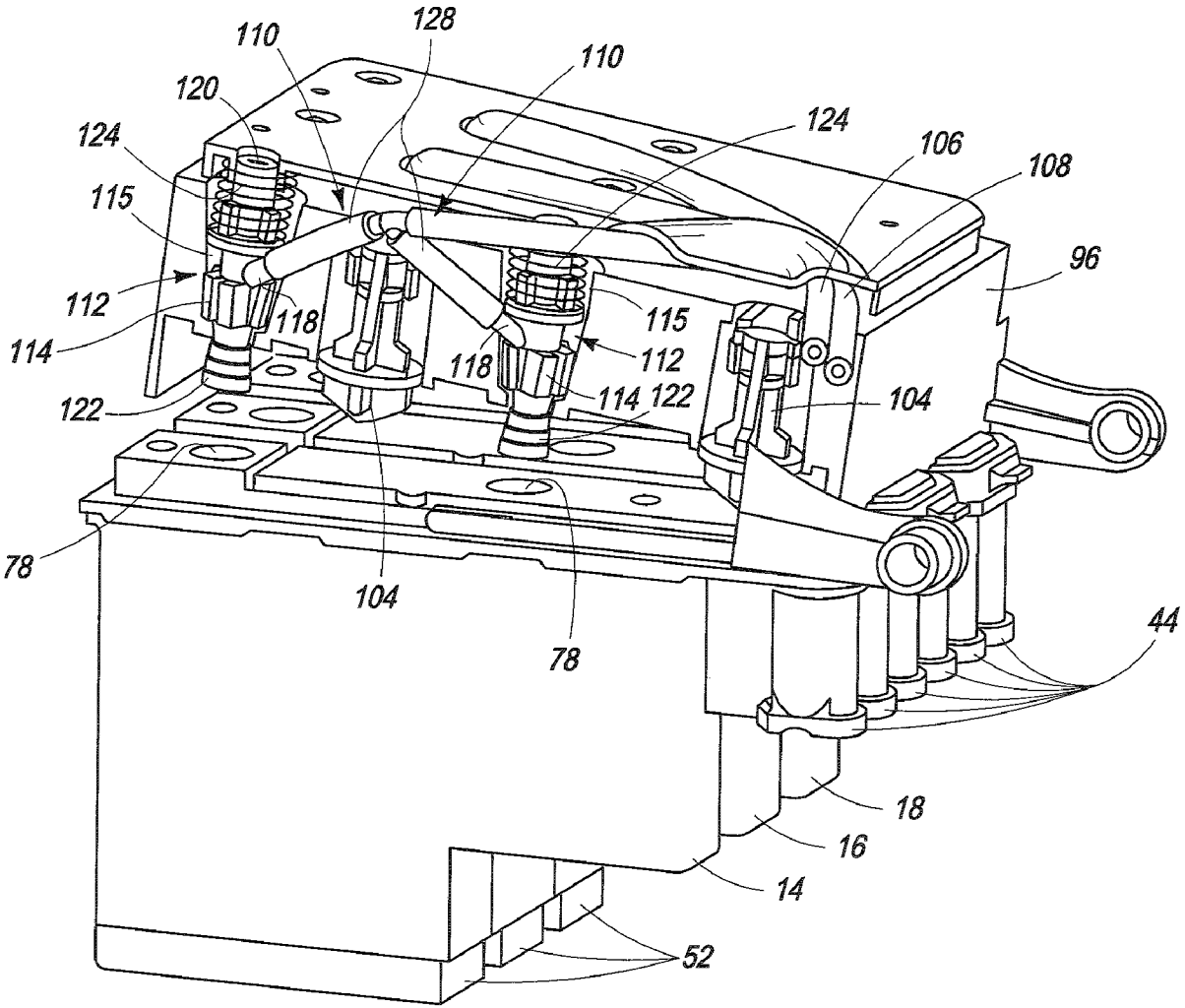
FIG. 7 is a perspective and partial cut-away view illustrating the interconnection between the pumping assembly and an ink pen in the carriage of FIGS. 4-6.

FIG. 7 is a perspective and partial cut-away view of cover 96 illustrating the interconnection between pump assembly 80 and ink pens 14-18. Referring now also to FIG. 7, pump assembly 80 includes tubes 106 and 108 connecting pumps 90 and 92 with an interconnection sub-assembly 110 in cover 96. In the embodiment shown, one tube 106, 108 from each pump 90, 92 supplies air through interconnection sub-assembly 110 to six vents 70 and the associated spring bags 56 on three ink pens 14-18. Interconnection sub-assembly 110 includes a spring loaded air port 112 for each vent 70 on ink pens 14-18. Only air ports 112 for vents 70 on ink pen 14 are visible in FIGS. 6 and 7.

Referring now specifically to FIGS. 6 and 7, each air port 112 includes a plunger 114 that moves in a socket 115 in cover 96. Plunger 114 defines an inner conduit 116. An air inlet 118 (FIG. 7) to plunger conduit 116 allows air from a pump 90, 92 to enter conduit 116. An air vent 120 at the top of plunger 116 allows venting into and out of plunger conduit 116. A rubber or other suitably compliant tip 122 on each plunger 114 fits into a vent opening 78 in pen housing 66 and seals in opening 78 and/or against vent fitment 72. A biasing spring 124 presses/biases plunger tip 122 against vent fitment 72 when cover 96 is in the closed position to maintain a secure connection between plunger 114 and vent 70. A labyrinth plug 126 in plunger vent 120 helps regulate air pressure applied to bag 56 through plunger 114. The carriage mounted pumps 90 and 92 are connected to each ink pen 14, 16 and 18 through the pen vents 70. Thus, when pens 14, 16 and 18 are used with the new carriage mounted pumping system, each pen vent 70 functions as an air port to the pen. Pen vents 70 no longer function by themselves as a vent. Rather, each pen vent 70 and the corresponding plunger vent 120 together provide the venting function for the pen.

When a pump 90, 92 is activated, the air bags 56 connected to the pump 90, 92 inflate and ink is forced out of the printhead nozzles 62 along with any air trapped in the printhead 52. During pumping, air leaks past labyrinth plugs 126 through plunger vents 120 to help prevent excessive air pressure that might damage an ink pen 14-18. Once pumping stops, air will continue to leak through vents 120 until returning to the ambient (e.g., atmospheric) pressure. In the embodiment shown, one pump 90 is connected to both regulator bags 56 in ink pen 14 through air distribution tubes 128 (FIG. 7) in cover 96, and the other pump 92 is connected to the regulator bags 56 in each of the other pens 116 and 118 through a corresponding set of distribution tubes (not shown). For the configuration shown in FIG. 1, in which pens 16 and 18 dispense cyan and magenta inks and pen 14 dispenses black and yellow inks, the cyan and magenta pens 16, 18 can be purged separately from the black and yellow pen 14. Yellow ink may often require more frequently purging than cyan and magenta inks. Thus, the embodiment of pump system 80 shown in FIGS. 4-7 helps conserve the cyan and magenta inks.

Embodiments of the new carriage mounted pumping system, pump system 80 for example, may be adapted for use with conventional ink pens such as ink pen 14 shown in FIG. 3. The operation of pump system 80 is transparent to the user. That is to say, a user places the ink pens in the carriage and closes and latches the cover just as if the pens were being installed in a conventional carriage. The pumps are connected to the pen automatically when the cover is closed and latched and ready for operation at the direction of the printer controller.

Pressure purging/priming pump system 80 does not use the accumulators, valves, or gearing of some conventional systems and, therefore, pump system 80 may be made more reliable and less costly than those conventional systems. Containing system 80 fully on-board the carriage eliminates the need for scan-path or service station tube routing and/or for making and breaking detachable connections for each purging/priming operation. It may be desirable under some circumstances, for better effectiveness, to wipe the printhead nozzle plate immediately after purging. Since the service station caps are not already in contact with the printhead, however, the wipers are immediately available for wiping after the purge. Also, a purging system separate from the capping station should contribute to greater effectiveness and increased durability of the capping station components.

As noted at the beginning of this Description, the example embodiments shown in the figures and described above illustrate but do not limit the disclosure. Other forms, details, and embodiments may be made and implemented. For example, it may be desirable in some fluid-jet dispensing applications to utilize more than one cover to retain the ejector cartridges, instead of the single cover shown in the Figures and described above. For another example, it may be desirable in some fluid-jet dispensing applications to utilize a carriage mounted pumping assembly to pump a liquid into a fluid-jet cartridge. Therefore, the foregoing description should not be construed to limit the scope of the disclosure, which is defined in the following claims. The article "a" or "an" as used in the claims means one or more.

What is claimed is:

1. A carriage for carrying a fluid ejector cartridge, comprising:

a body having a bay therein for holding a fluid ejector cartridge;

a pump mounted to the body;

a retaining cover connected to the body, the cover movable between an open position in which the cartridge may be installed in or removed from the bay and a closed position in which the cover contacts the cartridge in the bay to help retain the cartridge in place in the bay; and a port disposed within the cover such that the cover port is connected to a port on the cartridge when the cartridge is installed in the bay and the cover is in the closed position, the cover port operatively connected to the pump so that a fluid may be pumped into the cartridge through the cover and cartridge ports, wherein the pump comprises an air pump and the port disposed in the cover comprises an air port disposed within the cover such that the cover air port is connected to an air port on the cartridge when the cartridge is installed in the bay and the cover is in the closed position, the cover air port operatively connected to the pump so that air may be pumped into the cartridge through the cover and cartridge air ports.

2. The carriage of claim 1, wherein:

the body comprises a body having a plurality of bays therein for holding a plurality of fluid ejector cartridges;

the pump comprises a plurality of pumps mounted to the body;

the retaining cover movable between an open position in which the cartridges may be installed in or removed from the bays and a closed position in which the cover contacts the cartridges in the bays to help retain the cartridges in place in the bays; and the cover port comprises a plurality of cover ports disposed within the cover such that each cover port is connected to a port on a corresponding one of the cartridges when the cartridges are installed in the bays and the cover is in the closed position, each cover port operatively connected to a pump so that a fluid may be pumped into each cartridge through a cover port and the corresponding cartridge port.

3. The carriage of claim 2, wherein the fluid ejector cartridge comprises an inkjet ink pen.

4. The carriage of claim 2, further comprising a vent in each of the cover ports.

5. The carriage of claim 2, wherein the retaining cover comprises only one retaining cover.

6. The carriage of claim 1, further comprising a vent in the cover air port.

7. A carriage for carrying fluid ejector cartridges, comprising:

a body having a plurality of bays therein for holding a plurality of fluid ejector cartridges;

an air pump mounted to the body;

a cartridge retaining cover connected to the body, the cover movable relative to the body between an open position in which the cartridges may be installed in or removed from the bays and a closed position in which the cover contacts the cartridges in the bays to help retain the cartridges in place in the bays;

an air interconnection assembly integrated into the cover, the assembly including:

a plurality of movable plungers each having a conduit therein through which air may pass to an air port part of the plunger and to a vent part of the plunger, each plunger disposed within a recess in the cover such that each plunger air port is connected to an air port on one of the cartridges when the cartridges are installed in the bays and the cover is in the closed position; and a tube connecting the conduit of each plunger to the pump so that air may be pumped into the cartridges through the conduit to the corresponding air port.

8. The carriage of claim 7, further comprising a plurality of biasing mechanisms each biasing a plunger against a cartridge when the cartridge is installed in the carriage and the cover is in the closed position.

9. The carriage of claim 7, wherein the air port part of each plunger is in fluid communication with a vent on a cartridge when the cartridge is installed in the carriage and the cover is in the closed position.

10. The carriage of claim 9, wherein the air port and vent parts of each plunger are positioned at opposite ends of the conduit.

11. The carriage of claim 7, wherein each plunger includes a tip fitting into a vent opening on a cartridge when the cartridge is installed in the carriage and the cover is in the closed position, and the air port part of the plunger is positioned at the tip.

12. The carriage of claim 11, wherein the tip of each plunger comprises a complaint tip that seals against a vent fitment on a cartridge when the cartridge is installed in the carriage and the cover is in the closed position.

13. The carriage of claim 7, wherein the pump comprises a plurality of pumps, the tube comprises a plurality of tubes and at least one plunger is connected to each pump through a corresponding one of the tubes.

14. A carriage for carrying inkjet ink pens, comprising:

a body having a plurality of bays therein for holding a plurality of ink pens;

a plurality of air pumps mounted to the body;

an ink pen retaining cover connected to the body, the cover movable relative to the body between an open position in which the ink pens may be installed in or removed from the bays and a closed position in which the cover contacts the ink pens in the bays to help retain the ink pens in place in the bays;

an air interconnection assembly integrated into the cover, the assembly including:

a plurality of movable plungers each having a conduit therein through which air may pass to an air port part of the plunger and to a vent part of the plunger, each plunger disposed within a recess in the cover such that the each plunger air port is connected to an air port on one of the ink pens when the ink pens are installed in the bays and the cover is in the closed position; and a plurality of tubes each connecting the conduit of one or more plungers to the pump so that air may be pumped into the ink pens through a conduit to the corresponding air port.

15. The carriage of claim 14, wherein one of the pumps is connected to a first one of the ink pens containing a first color ink and a second one of the pumps is connected to a second one of the ink pens containing a second color ink different from the first color ink, when the ink pens are installed in the bays and the cover is in the closed position.

16. The carriage of claim 15, wherein the first color ink is yellow ink.

17. The carriage of claim 15, wherein the first one of the ink pens comprises a single dual-color ink pen containing yellow ink and black ink and the second one of the ink pens comprises at least one dual-color ink pen containing magenta ink and cyan ink.

18. The carriage of claim 14, wherein each plunger includes a tip fitting into a vent opening on an ink pen when the ink pens are installed in the bays and the cover is in the closed position, and the air port part of the plunger is positioned at the tip.

19. The carriage of claim 18, wherein the tip of each plunger comprises a complaint tip that seals against a vent fitment on an ink pen when the ink pens are installed in the bays and the cover is in the closed position.

* * * * *